US009556013B2

(12) United States Patent
Waizenauer et al.

(10) Patent No.: US 9,556,013 B2
(45) Date of Patent: Jan. 31, 2017

(54) CONVEYING DEVICE

(71) Applicants: Dietmar Waizenauer, Kematen an der Krems (AT); Bernhard Waizenauer, Allhaming (AT)

(72) Inventors: Dietmar Waizenauer, Kematen an der Krems (AT); Bernhard Waizenauer, Allhaming (AT)

( * ) Notice: Subject to any disclaimer, the term of this patent is extended or adjusted under 35 U.S.C. 154(b) by 27 days.

(21) Appl. No.: 14/759,468

(22) PCT Filed: Jan. 7, 2014

(86) PCT No.: PCT/AT2014/050002

§ 371 (c)(1),
(2) Date: Jul. 7, 2015

(87) PCT Pub. No.: WO2014/106283

PCT Pub. Date: Jul. 10, 2014

(65) Prior Publication Data

US 2016/0002025 A1 Jan. 7, 2016

(30) Foreign Application Priority Data

Jan. 7, 2013 (AT) ..... A 12/2013

(51) Int. Cl.
*B67D 7/84* (2010.01)
*B67D 7/64* (2010.01)

(52) U.S. Cl.
CPC . *B67D 7/84* (2013.01); *B67D 7/64* (2013.01); *B67D 7/645* (2013.01)

(58) Field of Classification Search
CPC ..... B67D 7/84; B67D 7/64; B67D 7/645
USPC ..... 222/405, 389, 135
See application file for complete search history.

(56) References Cited

U.S. PATENT DOCUMENTS 2,630,248 A 3/1953 Hinz
2,925,941 A * 2/1960 Bloxom ..... F16N 13/16 222/254
3,637,111 A * 1/1972 McCreary ..... B29B 13/022 222/146.1
3,976,229 A * 8/1976 Jackson ..... B29B 13/022 219/421

(Continued)

FOREIGN PATENT DOCUMENTS

DE 19817673 A1 11/1998
DE 202011100756 U1 8/2012

(Continued)

OTHER PUBLICATIONS

International Search Report issued May 27, 2014 in International Application No. PCT/AT2014/050002.

(Continued)

*Primary Examiner* — Donnell Long
(74) *Attorney, Agent, or Firm* — Panitch Schwarze Belisario & Nadel LLP

(57) ABSTRACT

A conveying device for conveying liquids, comprising at least one container (9) in which the liquid is located and which is located on a pallet (1), and at least one pump (7) for conveying the liquid, wherein said pallet (1) can be introduced into said conveying device and the at least one pump (7) is connected to a follower plate (8) and height of said follower plate (8) can be adjusted, the follower plate (8) lying on the liquid surface and closing sealingly with the container (9).

17 Claims, 8 Drawing Sheets

(56) References Cited

U.S. PATENT DOCUMENTS

| | | | | |
|---|---|---|---|---|
| 3,982,669 | A * | 9/1976 | Moore | B29B 13/022 222/146.5 |
| 4,632,281 | A | 12/1986 | Wold | |
| 6,755,427 | B1 | 6/2004 | Bray | |
| 2011/0084459 | A1 * | 4/2011 | Hergeth | B62B 3/04 280/47.35 |

FOREIGN PATENT DOCUMENTS

| | | | |
|---|---|---|---|
| EP | 0878439 | A1 | 11/1998 |
| EP | 1331072 | A1 | 7/2003 |
| EP | 2524886 | A1 | 11/2012 |
| JP | 2004183508 | | 7/2004 |
| WO | 2009036750 | A2 | 3/2009 |

OTHER PUBLICATIONS

English translation of International Preliminary Report on Patentability issued in International Application No. PCT/AT2014/050002.

* cited by examiner

CONVEYING DEVICE

CROSS-REFERENCE TO RELATED APPLICATION

This application is a Section 371 of International Application No. PCT/AT2014/050002, filed Jan. 1, 2014, which was published in the German language on Jul. 10, 2014, under International Publication No. WO 2014/106283 A1, and the disclosure of which is incorporated herein by reference.

The invention relates to a conveying device.

Conveying liquids poses particular challenges to conveying devices. They are supposed to be quick, efficient and inexpensive and able to achieve exact conveying of at least one liquid.

A conveying facility removes the medium from standardized containers, which are placed in the device manually. In 2-component applications, preferably 2 components with a shared batch number are supplied, which then need to be mixed and used up together (if the provided material was produced by a batch process).

So far, containers were manually introduced into the conveying device individually. In conditions of confined space and with the enormous weight that has to be handled, one will soon reach the workload limits set by law. Additionally, in multi-component applications, the containers must not be swapped, as this would contaminate the conveying device, which would then have to be cleaned laboriously. Hosepipes are difficult to clean. They need to be exchanged afterwards.

The conveying and mixing facilities currently on the market have sliding rails or roll-in devices for receiving the material containers mounted thereon, which are used to introduce the containers into the conveying device. Stops in the devices define the container positions. In 2-component facilities, loading has to be from both sides, as the stops prevent continuous loading from one side.

The material containers are supplied by the manufacturer on wood pallets. The containers then have to be pushed onto the sliding rails or roll-in devices using great physical effort. Wood pallets must not be introduced into production in a clean-room production or a production with elevated cleanliness requirements. In these cases, the barrels have to be reloaded.

In some cases, barrel lifters can be used, but this depends on the construction design and manufacturer of the conveying facility. Direct introduction using an indoor crane and a suitable transport device is not possible in most cases, as the conveying pumps are above the barrels and this interfering contour renders loading from above impossible.

It is an object of the present invention to provide a conveying device, in which time is saved by quick change of containers and less physical effort and less work is required from the operator during said change.

According to the invention, this is achieved by providing a conveying device comprising at least one container, in which a liquid is located and which is located on a pallet, and at least one pump for conveying the liquid, wherein the pallet can be introduced into said conveying device and the at least one pump (7) is connected to a follower plate (8) and the height of said follower plate (8) can be adjusted, the follower plate (8) lying on the liquid surface and closing sealingly with the container (9).

No laborious transferring of containers to the conveying device is necessary. Containers often cannot be moved by a stacker truck or similar auxiliary equipment as usually present in a production hall, but have to be moved laboriously by hand. A pallet, on the other hand, can be easily moved using a stacker truck or similar equipment. There are no problems with worker protection, and even persons who are not particularly strong can operate the conveying device. For example, the pallet on which the containers are supplied can be pushed into the conveying device directly. Multiple containers can be delivered to the conveying device in a single delivery operation. The procedural efforts is dramatically simplified as compared to conveying the containers individually. A pallet is defined as a flat construction used for transporting articles. As pumps, for example, extrusion pumps (chop check pumps) or screw spindle pumps are possible, but also other pumps suitable for conveying the liquids.

One embodiment of the invention can include at least two containers, in each of which a liquid is located and which are located on a pallet, and at least two pumps for conveying the liquids, wherein the pallet can be introduced into said conveying device. This embodiment is also suitable for mixing at least two liquids, which is why it can also be referred to as a mixing device. The simultaneous introduction of two or more containers on a pallet into the conveying device facilitates loading onto the conveying device, allowing loading onto the conveying device to take place in a more economical and time-saving manner.

In one embodiment of the present invention, the pallet can be introduced via a conveyor system. In this case, the pallet is loaded into the conveying device in a continuous process. Multiple pallets can find space onto the conveyor system before and after the conveying device. This way, preparation for loading can take place during production. For changing, the pallet that is clamped in simply has to be rolled out on one side and a new pallet rolled in on the other side. The conveyor system and the pallet can be realized such that improper orientation of the pallet cannot occur. The conveyor system can be realized such that it allows loading via a lift truck. The conveyor system can be powered electrically, so that changes of pallets can be performed fully automated.

In another embodiment of the present invention, the conveyor system can be a roller conveyor, a rollerway, roller rails or a conveyor belt. In a roller conveyor and a rollerway, multiple rolls are arranged successively, so that the pallet can be placed thereon. The pallet can be rolled into the conveying device via the rolls of the roller conveyor and the rollerway. In roller rails, the rolls are arranged on rails, i.e. the conveyor system consists of at least two roller rails separated from one another but arranged such that they can receive a pallet and that the pallet can be moved into the conveying device on the rolls. A conveyor belt is a belt made of an elastic material, which can be moved and receive a pallet. All conveyor systems listed here have in common that they can be operated mechanically, electrically or by gravity and introduce the pallet into the conveying device. They can also be automated.

In one embodiment of the invention, the pallet is introduceable into the conveying device in exactly one orientation. This means that the pallet can be introduced into the conveying device in exactly one orientation. Once the containers are properly arranged on the pallet, they cannot be mixed up anymore when being introduced into the conveying device.

In one embodiment of the present invention, the conveying device and the pallet can form a form-fit (positive) association which can only be formed in one orientation of the pallet. This form-fit association is provided, for example, by a protruding pin in the conveying device and a receiving area for the pin in the pallet, with the pin being insertable into the pallet only in one direction. This way, the pallet cannot by introduced into the conveying device in a reverse (wrong) orientation, rendering incorrect arrangement of the containers in the conveying device impossible. The form-fit association can also be an interfering contour of the pallet, which will only avoid colliding with the conveying facility in a correct slide-in direction.

In one embodiment of the invention, the pallet can have an interfering contour facing inwards and an interfering contour facing outwards, "facing inwards" meaning facing the center of the pallet and "facing outwards" meaning facing away from the outside of the pallet. These interfering contours prevent inserting the pallet into the conveying device in an incorrect orientation. The conveying device is designed such that it is able to receive the interfering contours of the pallet only in one orientation, but from both directions. It is therefore possible to introduce the pallet into the conveying device form both of its sides, while at the same time reverse introduction, i.e. swapping the containers in the conveying device, is not possible. "Interfering contour" in this context means that the pallet is designed such that the design interferes with introducing the pallet in an orientation, i.e. the pallet can only be introduced in an orientation in which the interfering contour is designed such as not to collide with the conveying device and to thus prevent introduction.

In another embodiment of the invention, the pallet can have a centering device for arresting in the conveying device. This centering device is calibrated on the conveying device, allowing exact orientation of the pallet in the conveying device and the pumps to fit exactly into the containers. Arresting can occur autonomously or using tools.

In one design of the invention, the conveying device can have a centering device for the pallet. The pallet is pushed into the conveying device until the pallet is correctly oriented at the centering device with the conveying device.

In another design of the present invention, the centering device on the pallet can positively engage with the centering device of the conveying device. Centering devices are disposed on both the pallet and the conveying device. The pallet is pushed into the conveying device until the centering device of the pallet positively engages the centering device of the conveying device. This allows exact orientation of the pallet, whereby the pumps can be fitted exactly into the containers and the conveying process can be initiated.

In yet another design of the invention, the pallet can have a centering device for a container. A container is placed on the pallet and moved until it is fitted into the centering device on the pallet. This way, the container is oriented exactly for the conveying device and the pump can be introduced into the container immediately without any problems.

In another embodiment of the invention, the pallet can have a coding. This coding indicates which content is to be found in which container. The coding can be a writeable data medium or be realized as a bar code, a two-dimensional QR code, a color code or a label. This prevents a mix up of containers in the conveying device. When the containers are commissioned for the pallet, all container data can be introduced or fed to the coding. This data can be read automatically by the conveying device, or manually by humans. For example, this data can be included into the conveying device's quality management protocol. Further, misloading with the wrong material can be prevented.

In a design of the present invention, the coding can be computer-writeable and computer-readable. In this case, the conveying device has a reader for the code. The code can be a bar code or a two-dimensional QR code. The reader is able to read the code and to evaluate it and compare it to the set value. If the found value matches the set value, the reader releases the conveying device and the conveying program can run as planned. If the found value and the set value do not match, there is an obvious misarrangement of the container on the pallet and activation of the conveying device is prevented. At the same time, an alarm can be sounded.

In another design of the invention, the coding can be readable by humans. A person compares the code with a specification and releases the conveying device manually. The code can be a color code, a specific pattern or simply a label indicating the contents of the container.

In one embodiment of the invention, the pallet can have the dimensions of a standardized pallet. This way, easy transport of the pallet is guaranteed, which can take place on standardized vehicles. A standardized pallet is, for example, a Europool pallet (also referred to as europallet), standardized by EN 13698-1 and multi-usable, having the dimensions 1200×800×144 mm (length×width×height). It is mostly made of wood.

In one embodiment of the invention, the pallet can have at least one receiving compartment for documentation. This means that there is a cavity in the pallet suitable for accommodating documentation. Such documentation is, for example, an indication of contents, use, risks, or the like. The documentation can be printed or present in electronic form on a data medium.

In a design of the present invention, the pallet is able to receive both 20-Liter containers and 200-Liter containers. 20-Liter containers and 200-Liter containers are the most widely used sizes in the industry. If the pallet is suitable for these two sizes, it covers the majority of conveying tasks that incur in a technical operation.

In another design of the invention, the pallet can be clean-room compatible. Conveying operations pose high challenges in terms of cleanliness in some situations, for example, in the food industry. These conveying operations take place in a clean room. If the entire pallet is introduced into the clean room, the pallet needs to be clean-room compatible, of course, i.e. it must be well rinseable and disinfectable, which in turn requires no cavities to be present, in which germs or other contaminants can be caught. Wood, for example, is not suitable for a clean room.

In one embodiment of the invention, the pallet can be made of plastic, steel, galvanized steel, or stainless steel. Such materials are clean-room compatible, as they can be cleaned quickly and completely and do not have pores and other cavities, which are difficult to clean or cannot be cleaned at all.

BRIEF DESCRIPTION OF THE DRAWINGS

In the figures, the reference numerals represent:

1 pallet

Figure 1:
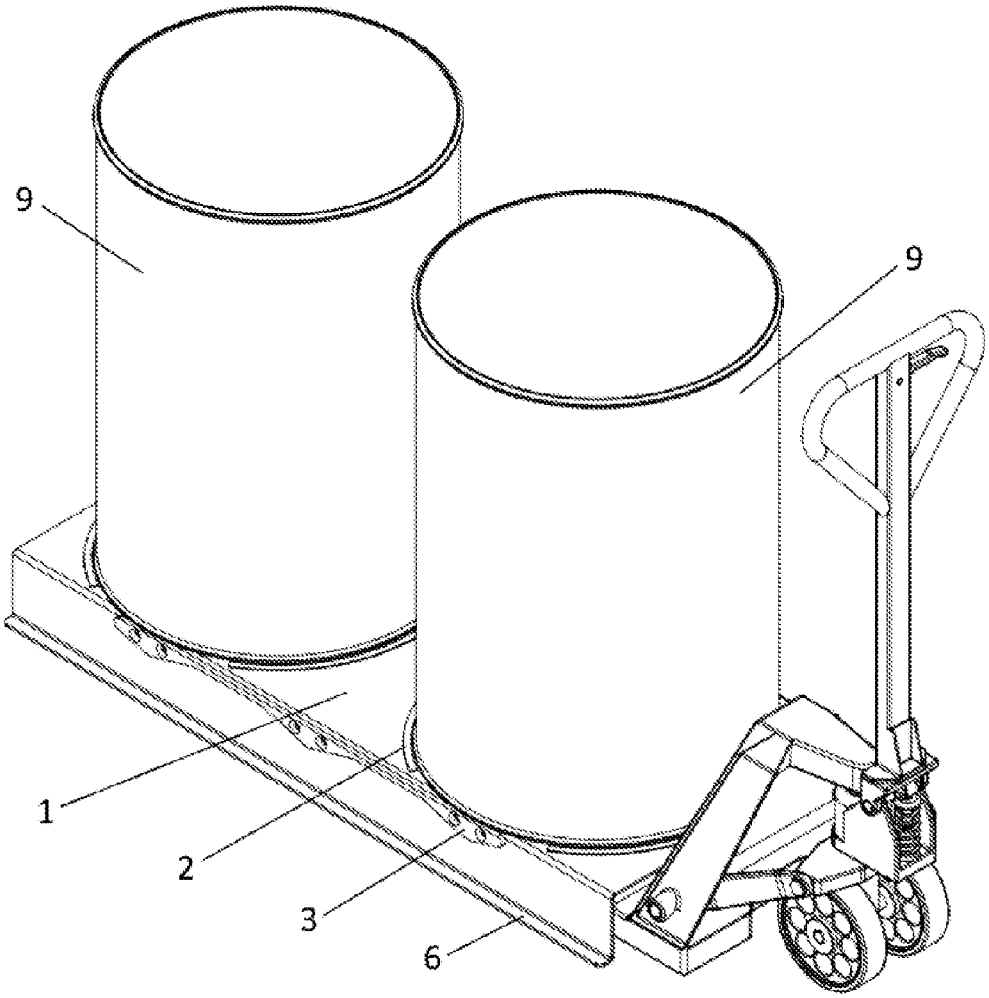

2 centering device for containers on the pallet

3 X/Y/Z centering device for pallet on the pallet

4 X/Y/Z centering device for pallet on the conveying device

5 interfering contour facing inwards

6 interfering contour facing outwards

7 pump

8 follower plate

9 container
10 bottom plate of the conveying device
11 high stop for container
12 low stop for container
13 barrel bottom support
14 label pallet side B
15 label pallet side A
16 slide bar
17 lift truck/transporting means
18 loading ramp
19 spring for resetting loading ramp
20 coding of orientation side B
21 coding of orientation side A
22 coding of orientation on pallet
23 X/Y/Z centering of pallet on bottom plate
24 lifting cylinder of conveying device FIG. 1 illustrates a pallet with two containers according to the invention.

Figure 2:
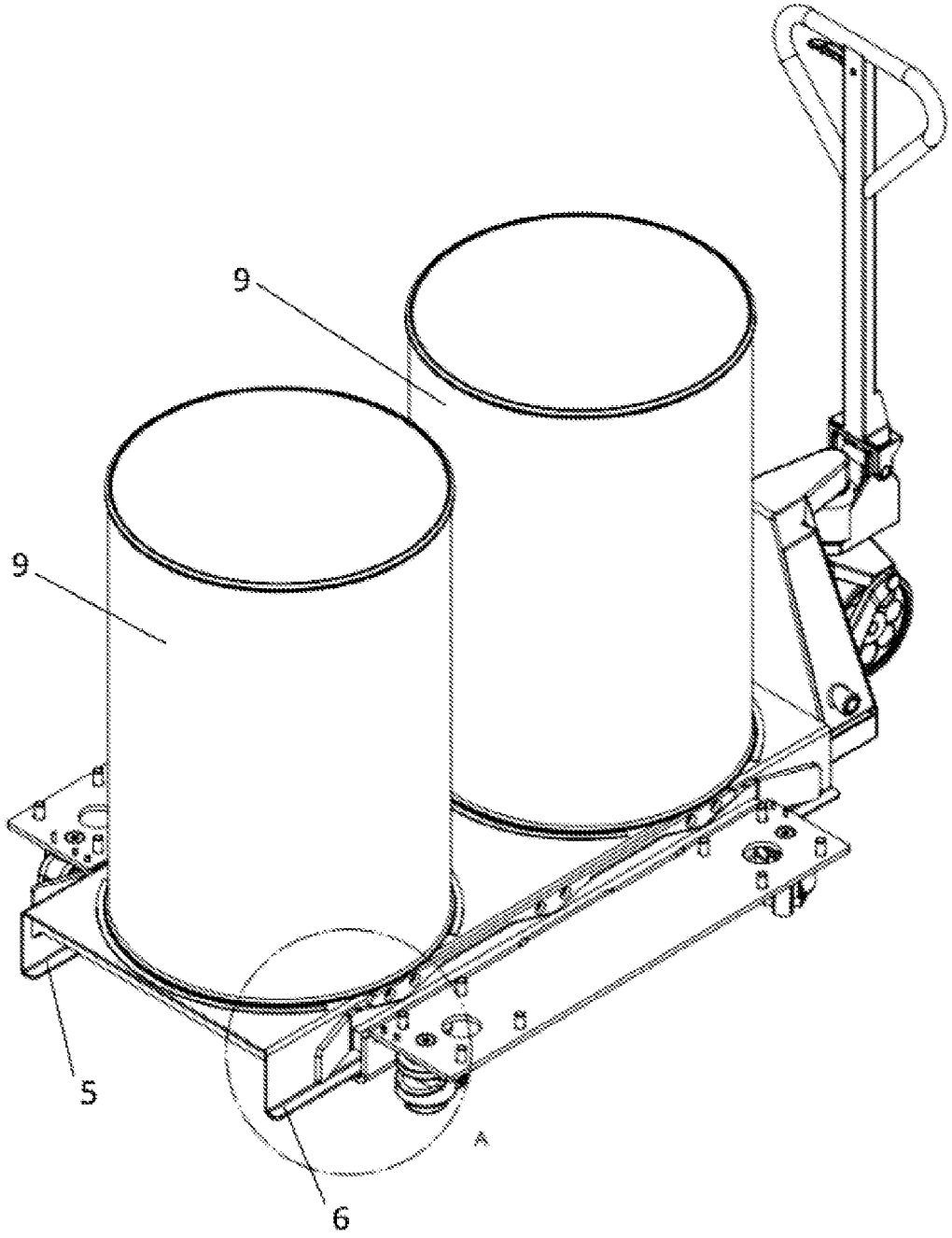

FIG. 2 illustrates a pallet according to the invention pushed into a conveying device according to the invention, wherein only the bottom plate is shown in the conveying device.

Figure 3:
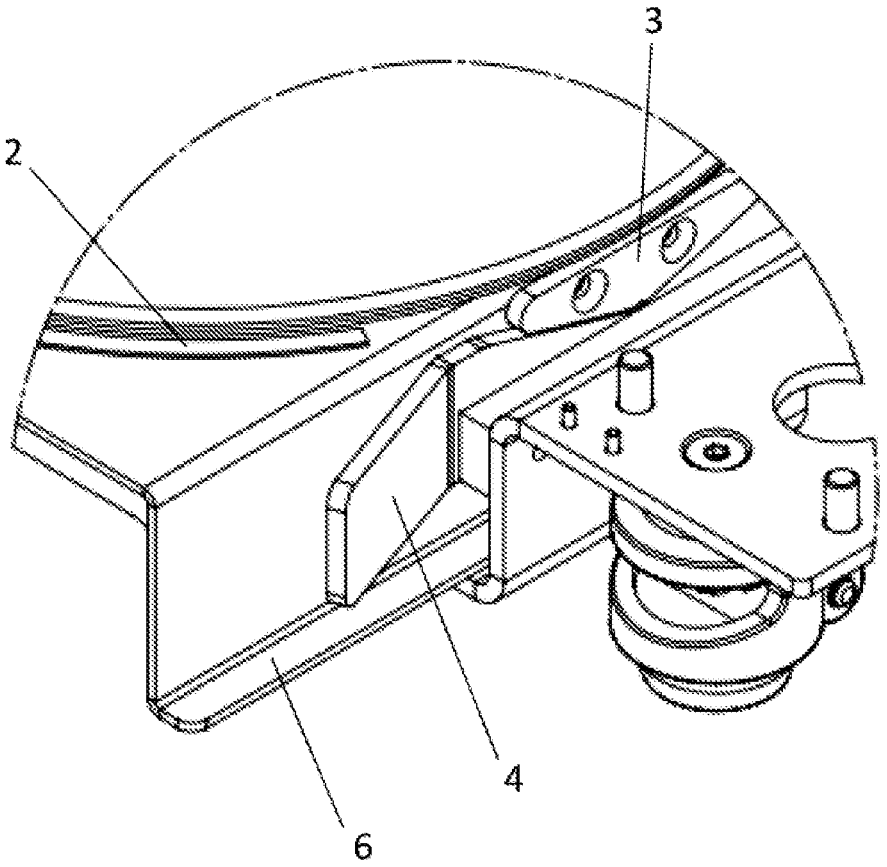

FIG. 3 illustrates a detail of FIG. 2 showing how the pallet is fixed and arrested in the conveying device.

Figure 4:
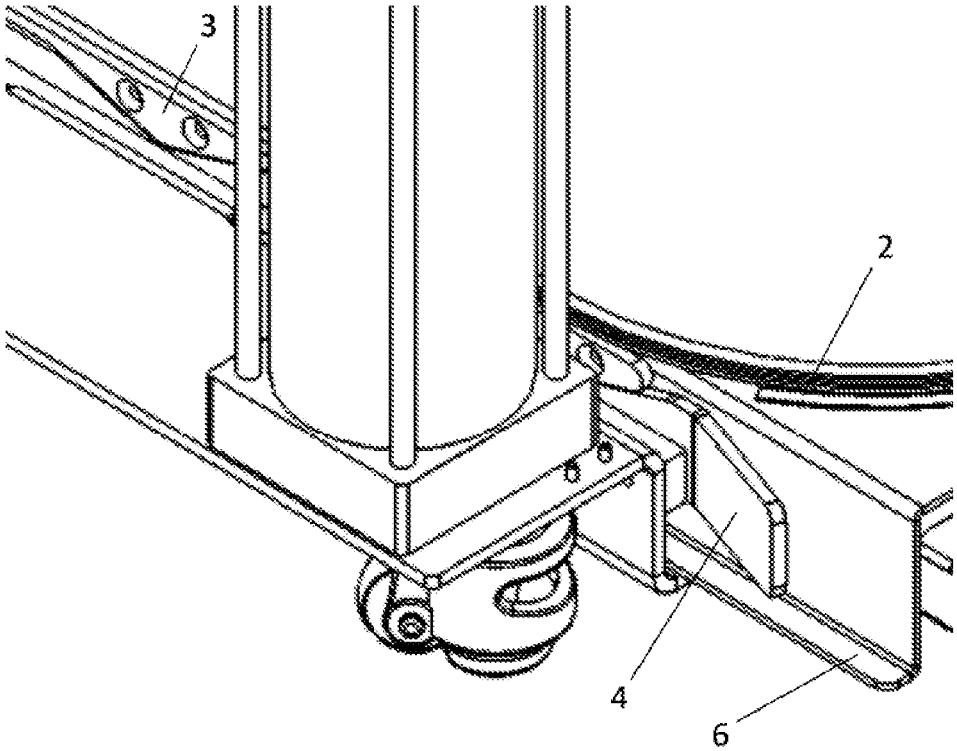

FIG. 4 illustrates a detail of a pallet according to the invention pushed into a conveying device.

Figure 5:
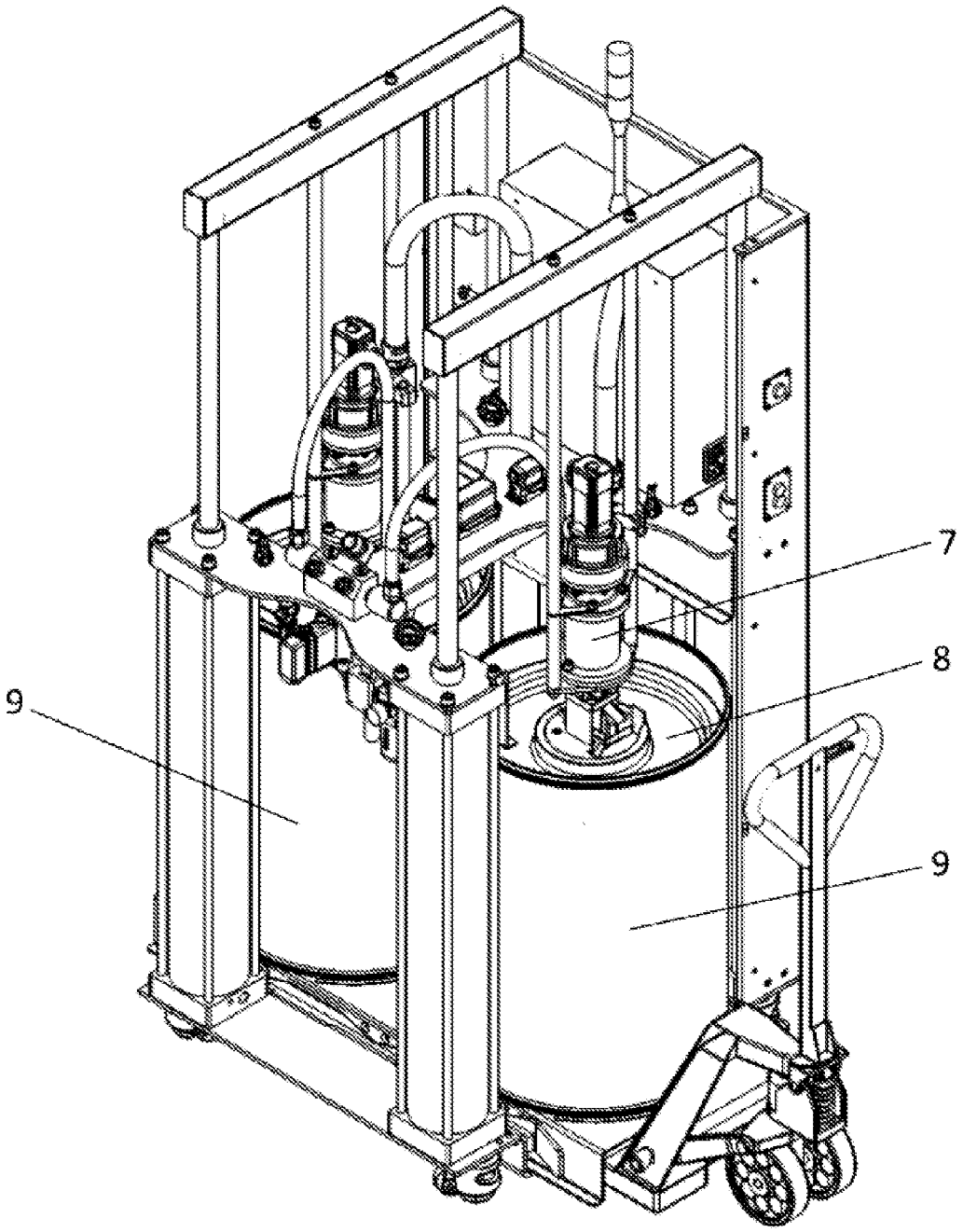

FIG. 5 illustrates a pallet according to the invention pushed in to a conveying device according to the invention.

Figure 6:
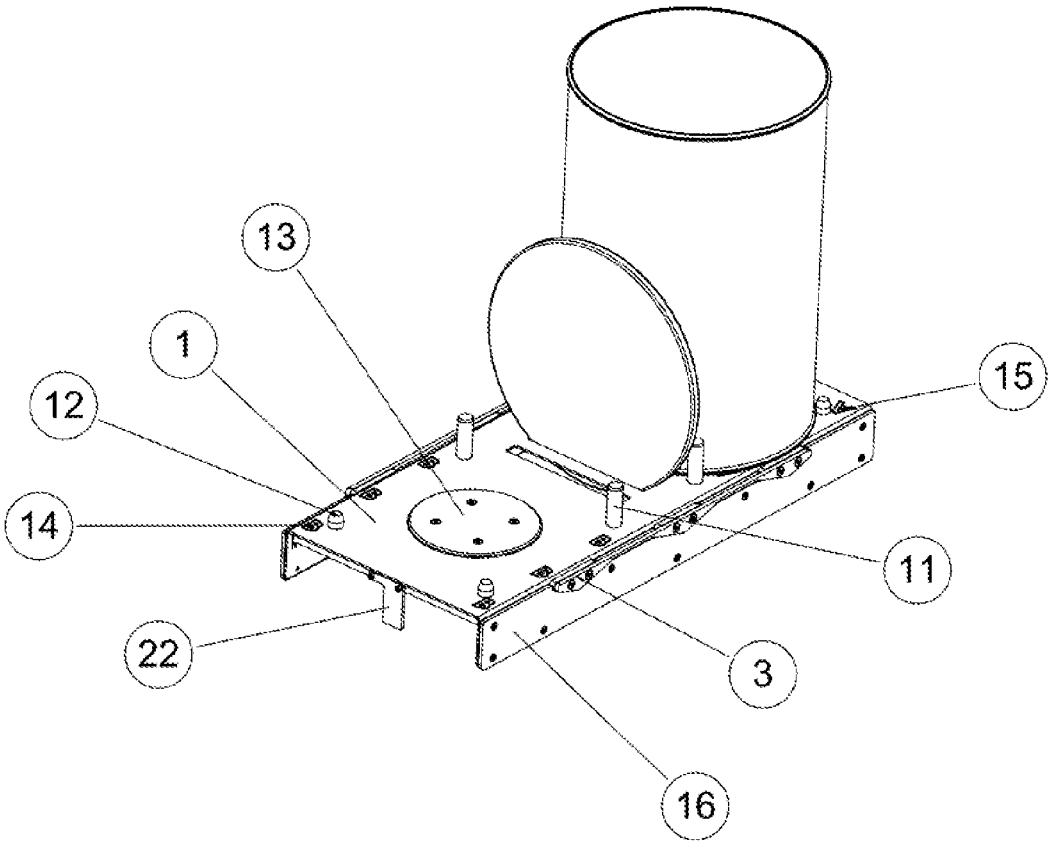
Figure 7:
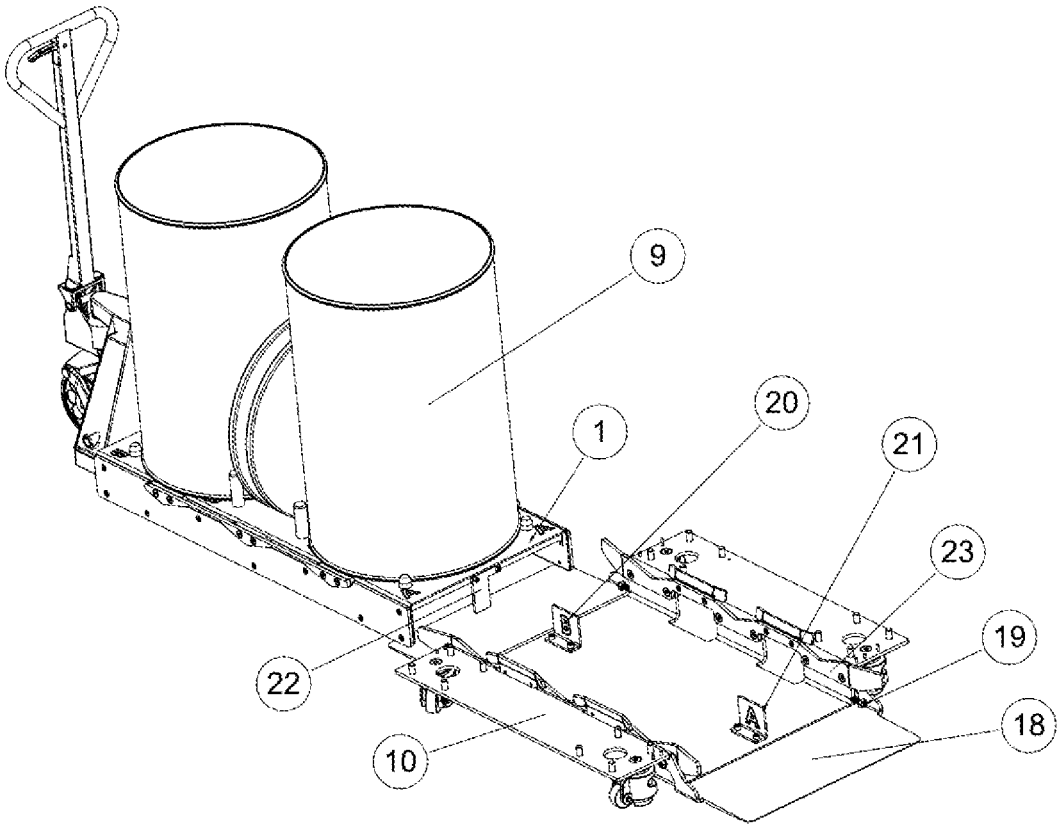
Figure 8:
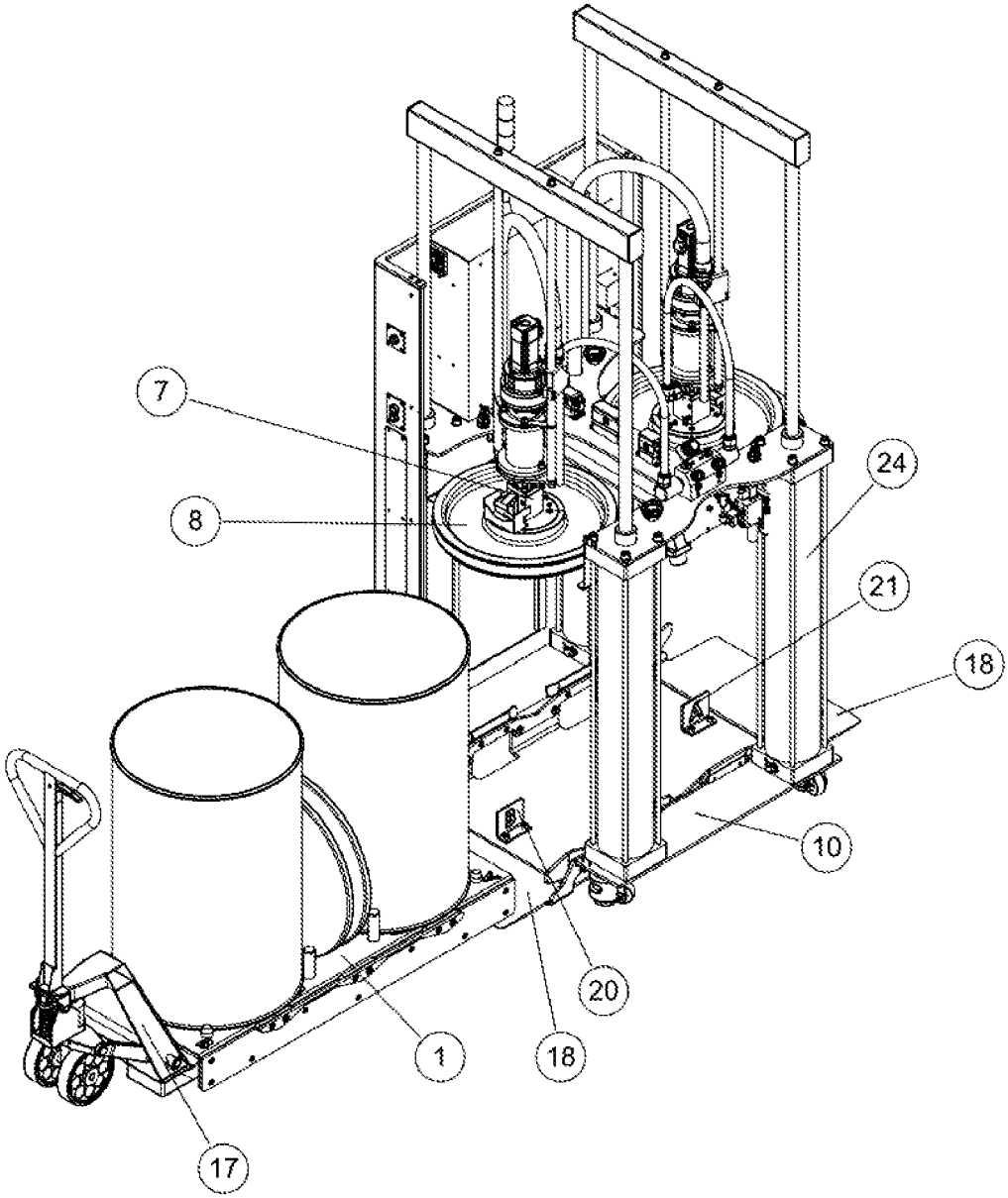

FIGS. 6-8 illustrate other embodiments of the invention.

EXAMPLE

A conveying device for conveying liquids comprises at least one container 9, in which a liquid is located and which is located on a pallet 1, and at least one pump 7 for conveying the liquid, wherein the pallet 1 can be introduced into said conveying device. The conveying device can also comprise at least two containers 9, in each of which a liquid is located and which are located on a pallet 1, and at least two pumps 7 for conveying the liquid, wherein the pallet 1 can be introduced into said conveying device. Such a conveying device comprising at least two containers 9 can be used for mixing the liquids present in the containers 9 and accordingly also be referred to as mixing device. Multiple containers 9 can be present on the pallet 1 and be pushed into the conveying device in a single conveying operation. If the container 9 is supplied on a pallet 1, said pallet 1 can be pushed directly into the conveying device. The procedural effort is thus dramatically simplified as compared to conveying the containers 9 individually. The pallet 1 can also be introduced into the conveying device in exactly one orientation. This is of relevance when there is more than one container 9. The containers 9 are arranged on the pallet 1 in a correct orientation. The pallet 1 can now be pushed into the conveying device in the single one possible orientation. It is thus no longer possible to mix up the containers 9. Introducing the pallet 1 is achieved from one side, with both containers 9 being introduced simultaneously. The pallet 1 is introduced into the conveying device by a stacker truck or similar equipment or can be introduced via a conveyor system as described below. The pumps 7 are introduced into the containers 9 and can remove the liquid in the desired amounts. Optionally, the pumps 7 can be mounted onto follower plates 8, which are placed onto the containers 9 and/or the liquid surface and close sealingly with the container 9. As pumps 7, for example, extrusion pumps (chop check pumps) or screw spindle pumps are possible, but also other pumps suitable for conveying the liquids. Removal of the pallet can be achieved from the other side from the one from which it was introduced.

The pallet 1 can be introduced via a conveyor system. The conveyor system can be a roller conveyor, a rollerway, roller rails or a conveyor belt. In a roller conveyor and a rollerway, multiple rolls are arranged successively, so that the pallet 1 can be placed thereon. The pallet 1 can be rolled into the conveying device via the rolls of the roller conveyor and the rollerway. In roller rails, the rolls are arranged on rails, i.e. the conveyor system consists of at least two roller rails separated from one another but arranged such that they can receive a pallet 1 and that the pallet 1 can be moved into the conveying device on the rolls. A conveyor belt is a belt made of an elastic material, which can be moved and receive a pallet 1. All conveyor systems listed here have in common that they can be operated mechanically, electrically or by gravity and introduce the pallet into the conveying device. They can also be automated. The pallet 1 is loaded into the conveying device in a continuous process. Multiple pallets 1 can find space onto the conveyor system before and after the conveying device. This way, preparation for loading can take place during production. For changing, the pallet 1 that is clamped in simply has to be rolled out on one side and a new pallet 1 rolled in on the other side. The conveyor system and the pallet 1 can be realized such that improper orientation of the pallet 1 cannot occur. The conveyor system can be realized such that it allows loading via a lift truck. The conveyor system can be powered electrically, so that changes of pallets can be performed fully automatically.

The conveying device can form a form-fit (positive) association with the pallet 1. For example, there can be pins on the conveying device that protrude into the area in which the pallet 1 is introduced, the pallet 1 having corresponding recesses that are able to receive the pins. The pins can be received by the pallet 1 in exactly one direction, preventing incorrect orientation of the pallet 1. Analogous and equivalent embodiments are also possible.

In one example, the pallet can have an interfering contour facing inwards 5 and an interfering contour facing outwards 6, "facing inwards" meaning facing the center of the pallet 1 and "facing outwards" meaning facing away from the outside of the pallet 1. These interfering contours 5, 6 prevent inserting the pallet 1 into the conveying device in an incorrect orientation. The conveying device is designed such that it is able to receive interfering contours 5, 6 of the pallet 1 only in one orientation, but from both directions. It is therefore possible to introduce the pallet 1 into the conveying device form both of its sides, while at the same time reverse introduction, i.e. swapping the containers 9 in the conveying device, when there is more than one container 9 on the pallet 1, is not possible. "Interfering contour" in this context means that the pallet 1 is designed such that the design interferes with introducing the pallet 1 in one orientation, i.e. the pallet 1 can only be introduced in an orientation in which interfering contour 5, 6 is designed such as not to collide with the conveying device and to thus rendering introduction impossible. For example, one interfering contour 5 is facing inwards, i.e. faces the center of the pallet 1, while the other interfering contour 6 is facing outwards, i.e. faces away from the center of the pallet 1. By accordingly designing the conveying device, the interfering contour facing outwards 6 interferes with introduction into the same in an orientation of the pallet 1. If the pallet 1 is reversed, the interfering contour facing outwards 6 is located on the other side of the conveying device, which is in turn designed such that it is able to receive the interfering contour facing outwards 6. Incorrect introduction, i.e. swapping the containers 9, is impossible using this system.

The pallet 1 can have a centering device 3 for arresting it in the conveying device. This centering device 3 is calibrated on the conveying device, allowing exact orientation of the pallet 1 in the conveying device and the pumps 7 to fit exactly into the containers 9. Such a centering device 3 can consist of holes in the side wall of the pallet 1, for example, through which a bolt or laser beam is passed, allowing exact positioning of the pallet 1. Arresting can be autonomous or using means of assistance.

In reverse, the conveying device itself can also have a centering device 4 for the pallet 1. The pallet 1 is pushed into the conveying device until the pallet 1 is correctly oriented with the conveying device at the centering device 4. A centering device 4 on the conveying device can be a metal sheet or equivalent directing medium that orients the pallet 1 correctly.

The centering device 3 on the pallet 1 can positively engage the centering device 4 of the conveying device. Centering devices 3, 4 are disposed both on the pallet 1 and the conveying device. The pallet 1 is pushed into the conveying device until the centering device 3 of the pallet positively engages the centering device 4 of the conveying device. This allows exact orientation of the pallet 1, whereby the pumps 7 can be exactly fitted into the containers 9 and the conveying process can be initiated.

Positive engagement of the centering device 4 of the conveying device by the centering device 3 on the pallet 1 can, for example, be by interlocking the two centering devices 3, 4 with both centering devices 3, 4 being designed as complementary, i.e. complementing each other to allow engagement.

The pallet can further have a centering device 2 for a container 9. A container 9 is placed on the pallet 1 and shifted such that it is fitted into the centering device 2 on the pallet. The container 9 is thus oriented exactly for the conveying device, and the pump 7 can be introduced into the container 9 immediately without any problems.

It is an object for the pallets 1 to have centering by which they can simply be released and arrested after being introduced into the conveying facility using a forklift or lift truck. Centering engages the pallet 1 when the pallet 1 is lowered onto the conveying facility and positions the same exactly underneath the conveying pumps 7. Due to the self-weight of the pallet 1 and the container 9 placed thereon these can no longer be shifted after lowering. This allows for quick and accurate positioning.

In order to be able to simultaneously empty the containers 9 in a multi-component conveying facility, the position of the follower plate 8 and/or the pumps 7 is usually measured with a metering system. The position of the follower plates 8 must be referenced in order to know at which position the containers 9 are fully emptied. This point is referred to as the zero point. In the case of wood pallets without height centering or a certain height tolerance, it may occur that the zero point is always different and simultaneous barrel evacuation is affected, as the zero points of component A and component B are not the same. In addition, it can occur that the pallets 1 have different dimensions depending on their manufacturers. Centering the pallet 1 via a centering device can secure that the zero point of the containers 9 is always the same, even when exchanged with a pallet 1 of the same construction.

The pallet 1 can further have a coding, which is, for example, computer-writeable or computer-readable or readable by humans. The coding can be a writeable data medium, a bar code, a two-dimensional QR code, a color code or a simple label indicating to the computer and/or human which contents are located in which container 9 and how to convey them. The conveying device can optionally have a reading device for the code, which can compare a found value with a set value and releases the conveying device in case of a match or blocks it in case of a mismatch. This can initiate an alarm. The same procedure can also be executed by a human. When commissioning the containers 9 for the pallet 1, all container data can be introduced or fed to the coding. This data can be read automatically by the conveying device, or manually by humans. For example, this data can be included into the conveying device's quality management protocol. Further, misloading with the wrong material can be prevented.

The pallet 1 can also have a recess that can accommodate documentation. The documentation can be printed or present in electronic form on a volume. Such documentation is, for example, an indication of contents, use, risks, or the like.

For example, the containers 9 can have a capacity of 20 Liters or 200 Liters. The pallet 1 is able to receive both of these container volumes, but also others. 20 Liters and 200 Liters are standard sizes in production plants.

Preferably, the pallet 1 is clean-room compatible and preferably consists of plastic, steel, galvanized steel or stainless steel. These materials are easy to clean and therefore compatible with a clean room. In a clean room, for example, foodstuffs are conveyed.

In another example, the conveying device has a bottom plate 10 having a coding of orientation 20, 21. The coding of orientation 20, 21 is different for all the different orientations, so coding 20 is different from coding 21. Pushing the pallet 1 in is possible in one orientation only. The push-in direction into the conveying device, however, can be chosen freely (either from the left or the right). The pallet 1 has a coding 22 of said orientation. This coding 22 engages coding 20 or 21 and allows the pallet 1 only one orientation. Coding 20, 21 can be realized very simply by disposing a small metal plate at a predefined distance from the longitudinal side of the bottom plate 10 perpendicular to the bottom plate 10. Coding 22 on the pallet 1 is associated with the distance of coding 20, 21 from the longitudinal side of the bottom plate 10 and is realized such that pushing the pallet 1 onto the bottom plate 10 is possible in only one orientation. In one orientation of the pallet 1, coding 20 allows the push-in in cooperation with coding 22, whereas said push-in is inhibited after turning the pallet 1 by 180° based on a cooperation between coding 21 and coding 22. When attempting to push the pallet 1 into the conveying device or the bottom plate 10, coding 21 collides with coding 22 and thereby prevents push-in in this orientation. Codings 20, 21, 22 are embodiments of the interfering contour 5, 6.

A loading ramp 18 can be present at the bottom plate 10 of the conveying device. Said loading ramp 18 allows pushing the pallet 1 onto the bottom plate 10. Springs 19 for resetting the loading ramp into an elevated or lowered state can be present. This serves to prevent the loading ramp from touching the ground when handling the conveying device and the production hall floor from being damaged. The centering device 2 for the container 9 on the pallet 1 can be designed as a low stop 12 for containers 9 or as a high stop 11 for containers 9. Said stops 11, 12 allow centering the containers 9 on the bottom plate 10 of the conveying device. The pallet 1 can have a label 14, 15, with label 14 being the label on side A and label 15 the label on side B of the pallet ("side A" and "side B" are intended to designate the different sides of the pallet). The pallet 1 can have slide bars 16 applied to the sides and allowing the pallet 1 to slide on the bottom. The bottom plate 10 can have an X/Y/Z centering 23 for the pallet 1. This X/Y/Z centering corresponds to centering 4 for the pallet 1 on the conveying device. "X/Y/Z centering" means that the pallet is centered in all three spatial directions and occupies a predefined spot.

The pallet 1 can be transported into the conveying device using a lift truck 17.

A possible area of application is conveyor systems for highly viscous media in LSR injection molding (LSR signifying liquid silicone rubber). The most widely used form of silicone processing is the application in classic injection molding procedures in connection with an injection molding machine. In such procedures, the material is metered in the screw conveyor of the injection molding machine in a 1:1 mixing ratio. The machine injects the material into the hot mold. The material is produced in a batch process. Components A and B must be transferred together.

Another possible area of application is conveyor systems for directly molding silicone. In direct molding, members of the device convey the material directly into a tool without using an injection molding machine. The material is produced in a batch process. Components A and B must be transferred together.

In the above conveyor systems, other materials can be conveyed as well, such as resins, glues, and foodstuffs, for example.

Another possible area of application is ram presses having pumps for various applications. Pumps with a follower plate and a lift cylinder are called ram presses. Various materials can be conveyed, such as resins, glues, and foodstuffs, for example.

The invention claimed is:

1. A conveying device for conveying liquids, comprising:

a pallet (1) forming a form-fit (positive) association with the conveying device in only one orientation of the pallet (1);

at least two containers (9), each container containing a liquid and being located on the pallet (1);

a pump (7) for conveying each of the liquids; and a follower plate (8) lying on a surface of the liquid in each container and to which the respective pump (7) is connected, wherein a height of the follower plate (8) can be adjusted, and wherein the follower plate (8) sealingly closes the container (9).

2. The conveying device of claim 1, wherein the pallet (1) has an interfering contour facing a center of the pallet (1) and an interfering contour facing away from an outside of the pallet (1).

3. The conveying device of claim 1, wherein the pallet (1) is introduced to the conveying device via a conveyor system.

4. The conveying device of claim 3, wherein the conveyor system is one of a roller conveyor, a rollerway, roller rails, and a conveyor belt.

5. The conveying device of claim 1, wherein the pallet (1) has a centering device (3) for arresting the pallet in the conveying device.

6. The conveying device of claim 5, further comprising a centering device (4) for the pallet (1).

7. The conveying device of claim 6, wherein the centering device (3) on the pallet (1) positively engages the centering device (4) of the conveying device.

8. The conveying device of claim 1, wherein the pallet (1) has a centering device (2) for a container (9).

9. The conveying device of claim 1, wherein the pallet (1) has a coding.

10. The conveying device of claim 9, wherein the coding is computer-writeable and computer-readable.

11. The conveying device of claim 9, wherein the coding is human-readable.

12. The conveying device of claim 1, wherein the pallet (1) has dimensions of a standardized pallet.

13. The conveying device of claim 1, wherein the pallet (1) has at least one receiving compartment for documentation.

14. The conveying device of claim 1, wherein the pallet (1) is able to receive both 20-liter containers and 200-liter containers.

15. The conveying device of claim 1, wherein the pallet (1) is clean-room compatible.

16. The conveying device of claim 1, wherein the pallet (1) is made of a material selected from plastic and steel.

17. The conveying device of claim 16, wherein the steel is selected from galvanized steel and stainless steel.

* * * * *